US006098872A

United States Patent [19]

Ong

[11] Patent Number: 6,098,872

[45] Date of Patent: Aug. 8, 2000

[54] OFFICE ENVELOPE

[76] Inventor: Bon S. Ong, Box 4247, Torrance, Calif. 90510

[21] Appl. No.: 09/347,736

[22] Filed: Jul. 6, 1999

[51] Int. Cl.[7] ..... B65D 27/08

[52] U.S. Cl. ..... 229/72; 229/71; 229/77; 229/928

[58] Field of Search ..... 229/72, 71, 70, 229/67.1, 67.3, 67.4, 928; 383/38, 39, 40, 120, 125, 126, 106

[56] References Cited

U.S. PATENT DOCUMENTS

D. 366,495 1/1996 Hirai .

*Primary Examiner*—Jes F. Pascua
*Attorney, Agent, or Firm*—Charles H. Thomas

[57] ABSTRACT

An office envelope is constructed of at least one flat sheet of stock of uniform thickness throughout folded to form overlying front and back panels and a pocket panel secured to the back panel. The panels are secured together by longitudinally extending heat seals located near the edges of the pocket panel. These edges are respectively secured to the back panel proximate the opposing side edges thereof. Also, one of the sides of the envelope is provided with an overlap margin that is also secured to the back panel. The overlap margin of the side panel may be secured to the back panel by the same seal that secures one of the sealing margins of the pocket panel to the back panel. Alternatively, separate seals may be utilized to secure the overlap margin of the side panel to the back panel and the pocket panel to the back panel by two closely spaced lines of sealing. The office envelope may be constructed from either a single sheet of flat stock, in which case all of the panels and flaps are formed from the same sheet of stock. Alternatively, the pocket panel and one of the bottom panels may be formed from one sheet of stock, and the front, back, and side panels and the other bottom panel may be formed from a different sheet of stock. When more than one sheet of stock is utilized to form the office envelope, a transparent sheet may be utilized to form the pocket panel and one bottom panel, while an opaque or translucent sheet of material may be utilized to form the other panels.

20 Claims, 12 Drawing Sheets

OFFICE ENVELOPE

BACKGROUND OF THE INVENTION

1. Field of the Invention

The present invention relates to an envelope for documents including a plurality of compartments of the type utilized in an office environment.

2. Description of the Prior Art

Various types of office envelopes having a plurality of compartments have been designed in the past. However, competition is quite great in the office supply industry. Moreover, due to the tremendous number of units of expendable supplies such as interoffice routing envelopes that are sold, even a small, incremental decrease in manufacturing costs produces a very significant overall savings in manufacturing, and provides the manufacturer with a considerable competitive edge.

The present invention involves a construction for an interoffice routing envelope which achieves an economy of construction as contrasted with conventional routing envelopes of this type. Like commercially available interoffice routing envelopes, the envelope of the invention provides a plurality of pockets. However, due to its unique construction, the envelope of the invention can be fabricated at a savings compared with comparable envelopes that are currently commercially available.

SUMMARY OF THE INVENTION

The present invention is a multicompartment office envelope which is constructed in a unique and novel manner. By utilizing an envelope construction according to the invention, a considerable economic savings in cost of manufacture can be achieved in producing envelopes of this type in large quantities.

In one broad aspect the invention may be considered to be an envelope for documents having an outside pocket and comprised of at least one sheet of flat stock cut and folded to form a front panel, a back panel, a web side panel, an overlap side panel, a pair of side panel bottom flaps, an inside bottom panel, an outside bottom panel, and a pocket panel. The pocket panel has opposite side edges with side sealing margins adjacent thereto. One of the front and back panels is delineated from the side panels by folds in the sheet. The other of the front and back panels has a longitudinally cut side edge defined by a cut end of the sheet. A first attachment margin on the other of the front and back panels lies immediately adjacent to the cut side edge thereof. The overlap side panel also has an attachment margin and a longitudinally cut side edge defined by another cut in the sheet immediately adjacent to the attachment margin thereof. The attachments margins of the overlap side panel and of the other of the front and back panels are sealed to each other throughout their lengths. One of the side sealing margins of the pocket panel is sealed to at least one of the attachment margins of the overlap side panel and the other of the front and back panels. The other of the sealing margins of the pocket panel is sealed to the other of the front and back panels adjacent to the web side panel. The bottom panels and the side panel bottom flaps are folded together and the bottom panels are sealed to each other.

The envelope of the invention may be formed from either one sheet or two sheets of flat stock, depending upon whether or not panels having different physical characteristics are desired. For example, it may be desirable for the complete structure of the envelope to be opaque. In such a case it is easiest and most economical to form the entire structure of the envelope from a single sheet of flat stock. When the envelope of the invention is constructed in this manner, all of the panels, flaps, margins, and edges are formed by articulated folds in the same sheet of flat stock. Alternatively, the front, back, and side panels, the side closure flaps, and one of the bottom panels may be formed from a first sheet of flat stock while the pocket panel and other bottom panel are formed of a second sheet of flat stock. This latter type of construction may be used, for example, when it is desirable for the pocket of the envelope to be transparent while the main enclosure of the envelope is opaque.

In all embodiments of the envelope of the invention, the front, back, and side panels are formed from the same sheet of flat stock so that one of the front and back panels is delineated by folds from side panels on both of its lateral sides. One of these side panels, which may be considered to be an overlap side panel, has an exposed longitudinally extending edge with an attachment or sealing margin located immediately adjacent thereto and extending the entire length of the overlap side panel. This sealing margin of the overlap panel faces, contacts and is sealed to a corresponding attachment or sealing margin of the other of the front and back panels which is not bounded by a side panel on both of its sides. This corresponding attachment margin lies adjacent an opposing cut edge defined by a cut in the sheet of the material that delineates the outer or exposed edge of the other of the front and back panels.

The sealing or attachment margins of both the overlap side panel and the other of the front and back panels are secured to each other throughout their mutually contacting lengths by thermal welds, solvent seals, adhesive, or other conventional means. Lateral closure of the main compartment of the envelope is performed near one of the lateral edges of either the front or back panel immediately adjacent the overlap side panel.

The overlying pocket panel that is sealed to the other of the front and back panels lying therebeneath may be sealed adjacent the overlap side panel by the same, longitudinal seal that joins the attachment margin of the overlap panel to the attachment margin of the other of the front and back panels. In this case the seal along the side of the envelope at the overlap side panel thereof may be a single, linear, thermal or other type of seal that extends through all of the layers at that location of the structural material from which the envelope is formed. Specifically, in this case the side sealing margin adjacent the edge of the pocket panel is sealed through the intermediate structure of either the attachment margin of the overlap side panel or the attachment margin of the other of the front and back panels to the remaining of these attachment margins located therebeneath.

In an alternative construction two different seals may be employed proximate the same edge of the pocket panel. Specifically, the attachment margins of the overlap panel and the other of the front and back panels having a sealing or attachment margin is performed with one longitudinally extending linear seal. Thereafter, a second longitudinally extending linear seal joins one of the side sealing margins of the pocket panel to the front or back panel of the base sheet located immediately therebeneath. In either case, all three plies of the material are attached to each other closely adjacent to each other at the overlap side panel. In the one case, one of the side sealing margins of the pocket panel is sealed to either the attachment margin of the overlap side panel or the attachment margin of the other of the front and back panels. In the other case, one of the side sealing margins of the pocket panel is sealed to both of the overlapping attachment margins of the overlap side panel and the other of the front and back panels. In both cases the other of the side sealing margins of the pocket panel is attached to the other of the front and back panels near the web side panel that extends between the front and back panels.

In the preferred construction of the invention, the one of the front and back panels that is bounded on both sides by the side panels by means of delineating demarcation folds therebetween is the front panel. The other of the front and back panels, that is the front and back panel having a sealing margin, is the back panel.

Of course, to form a document compartment in an envelope it is necessary to seal not only the sides of the compartment, but the bottom as well. In the envelope of the invention, the bottom is closed by sealing together one bottom panel extending from the base structure and another bottom panel extending from the overlying pocket structure. The bottom panels from these two structures project toward each other and reside in overlapping relationship, preferably throughout both their length and width. Also, the side panels on the base structure are formed with end closure flaps which project inwardly and also in an overlying relationship with the bottom panels a short distance in from the envelope sides. A single, laterally extending, linear thermal or other type of seal across the bottom of the structure can then be used to permanently close the bottom of the envelope. Preferably, the inside bottom panel, that is the bottom panel facing inwardly toward the bottom of the main compartment, is delineated by a bottom fold from one of the front and back panels. The outside bottom panel is delineated by another bottom fold from the pocket panel. Alternatively, however, the bottom panel projecting from the pocket panel may serve as the inner bottom panel, while the bottom panel projecting from the front or back panel may serve as the outer panel.

The invention is preferably also constructed with a closure flap projecting from the back panel and extending thereacross throughout its width. The closure flap is folded down to overlap the upper portion of the front panel. In a preferred construction of the envelope of the invention, some releasable fastening system employing button closures secured together by string, flexible hook and loop fastening pads, snaps, or interlocking clasps is used to releasably secure the closure flap to hold the top of the main compartment of the envelope shut and thereby prevent documents from inadvertently falling from the mouth of the envelope. The releasable closure flap engagement elements employed hold the closure flap folded over to envelop a portion of the front panel remote from the bottom panels.

Preferably also, the envelope is provided with a retaining tab that projects from the top of the pocket panel remote from the bottom panel. The retaining tab is folded down into the outside pocket of the structure back toward the bottom panels. The retaining tab thereby serves as a means for securing an item such as a routing sheet in the outside pocket of the envelope.

In some embodiments of the invention it may be desirable for the outer pocket to be formed of a transparent material, while the main base or body of the envelope is formed of an opaque material. In this construction, the front panel, the back panel, the top closure flap, the side panels, the side panel bottom flaps, and one of the bottom panels are formed from the same sheet of flat stock, which is fabricated of an opaque material. This opaque material may be manila paper, opaque-colored polypropylene, opaque card stock, or any other conventional opaque, flat sheet stock material. When the outer pocket is to be transparent, the pocket panel and the other bottom panel are formed of a different sheet of flat stock. For example, the pocket panel and the other bottom panel may be formed of a transparent sheet of polypropylene.

In preferred constructions of the invention, the office envelope is capable of being reduced to a flattened state. This is achieved by forming pleats in the side panels and by delineating a fold near either the bottom of the pocket panel and the other of the front and back panels which it immediately overlies. By folding the structure at this fold line, the envelope can be reduced to a very flat condition which is suitable for shipment, sale, and storage of a quantity of envelopes of this type. However, in use, the folded over bottom of the structure can be unflattened and the pleated sides expanded to further separate the front and back panels from each other so that the main compartment of the envelope can hold a considerable quantity of documents.

In another aspect the invention may be considered to be an office envelope comprised of a base sheet of stock of uniform thickness throughout and a pocket sheet of uniform thickness throughout. The base sheet is folded to form overlying front and back panels laterally separated by a pair of side panels. One of the front and back panels is laterally bounded on both sides by the side panels and is delineated therefrom by longitudinal folds in the base sheet. The other of the front and back panels is laterally bounded on only one of its sides by one of the side panels. This other of the front and back panels has a longitudinal die cut edge with an edge margin adjacent thereto extending its length. One of the side panels is located between the front and back panels and is delineated therefrom by longitudinal folds in the base sheet. The other of the side panels has a longitudinal die cut edge with an edge margin adjacent thereto extending throughout its length. The edge margins of the other side panel and of the other of the front and back panels overlap and are sealed together throughout their lengths.

The base sheet further defines a base sheet bottom panel projecting from the one of the front and back panels bounded on both sides by the side panels. The base sheet also further defines side end flaps projecting from the side panels adjacent the base sheet bottom panel.

The pocket sheet is folded to form a pocket panel overlying the other of the front and back panels. The pocket sheet has opposing longitudinal side edges with pocket panel edge margins adjacent thereto and extending throughout the length of the pocket panel. A pocket sheet bottom panel projects from the pocket panel. Both of the bottom panels and the side end flaps are folded into a mutually overlying relationship and the bottom panels are sealed together. One of the pocket panel side edge margins is sealed throughout its length to at least one of the edge margins of the base sheet that overlap each other. The other of the pocket panel side edge margins is sealed throughout its length to the other of the front and back panels remote from the edge margins of the base sheet.

In one embodiment of the invention, one of the pocket panel side edge margins is sealed to only the edge margin of the other side panel. In an alternative embodiment, one of the pocket panel side edge margins is sealed to both the edge margin of the other side panel and the edge margin of the other of the front and back panels.

The invention may be described with greater clarity and particularity by reference to the accompanying drawings.

DESCRIPTION OF THE EMBODIMENT

Figure 2:
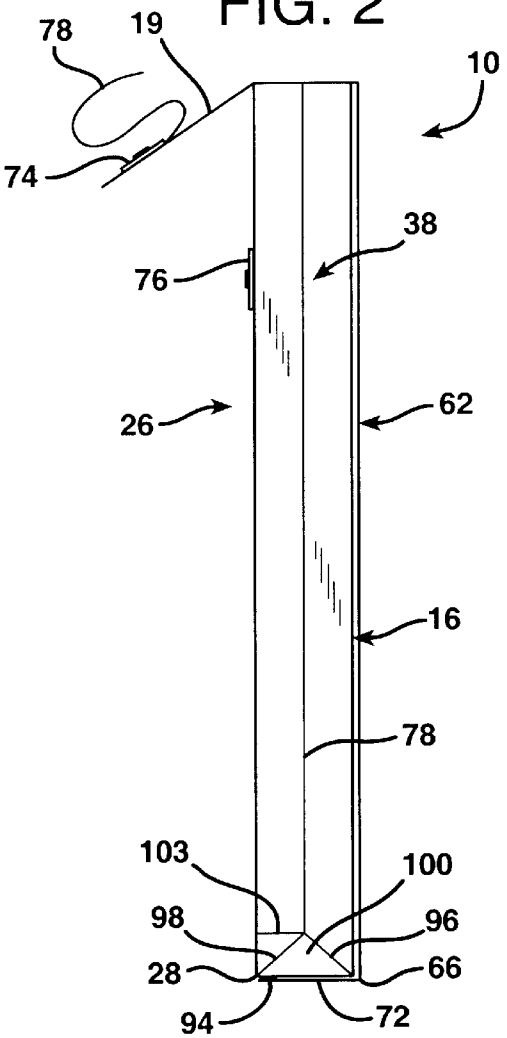
FIG. 2 is a right-side elevational view of the office envelope of FIG. 1.
Figure 1:
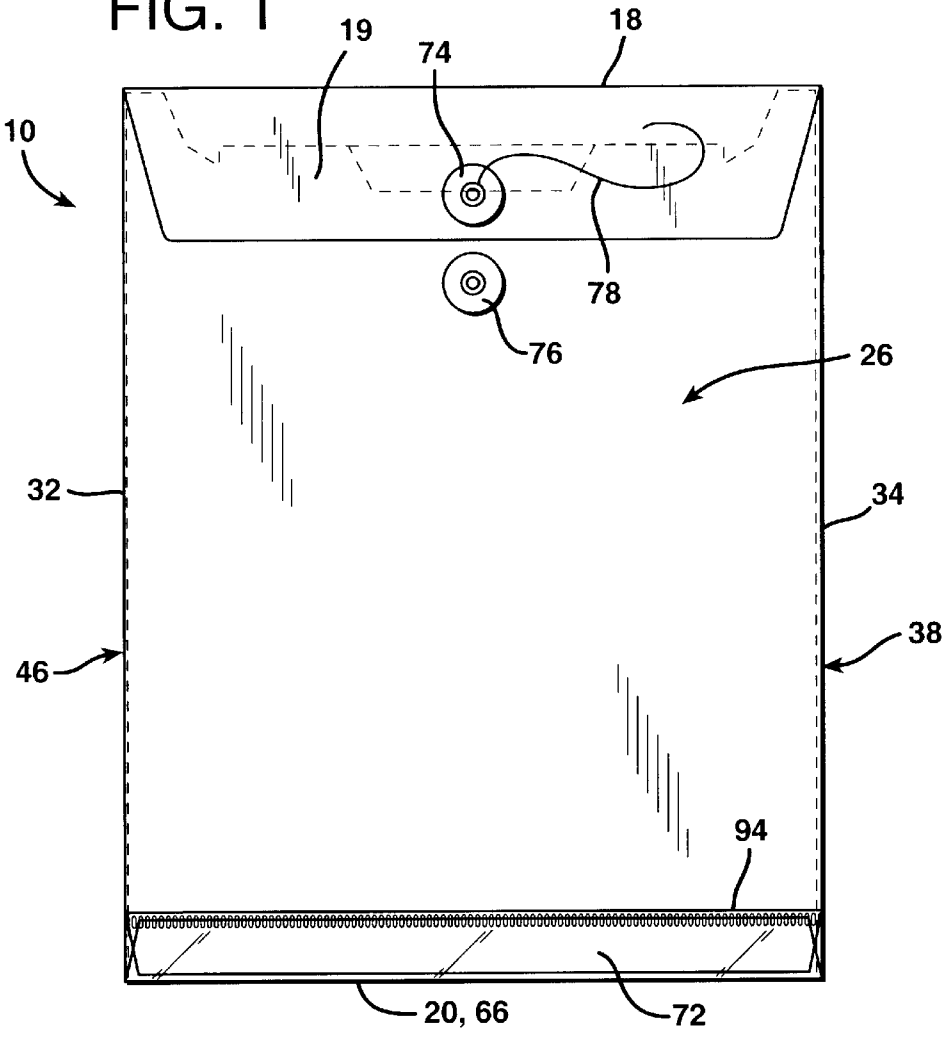
FIG. 1 is a front elevational view of one preferred embodiment of an office envelope according to the invention.
Figure 7:
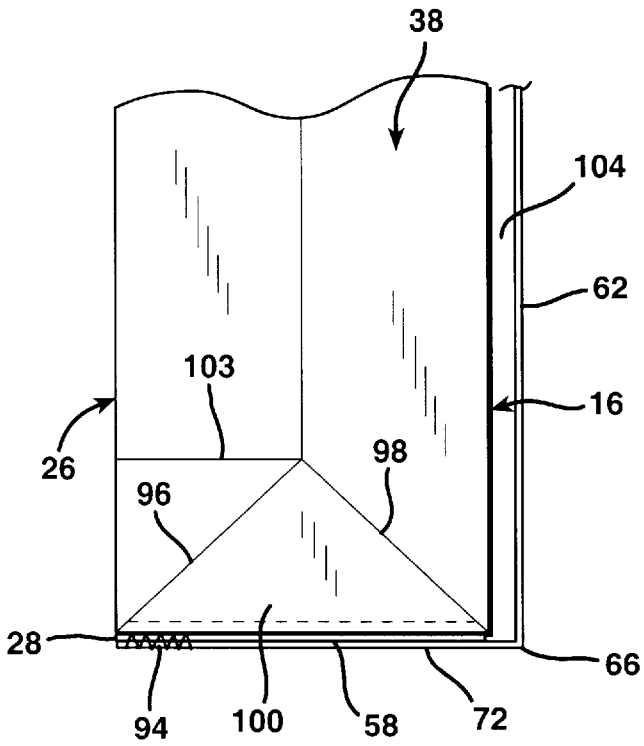
FIG. 7 is a left-side elevational detail illustrating the portion of the envelope shown in FIG. 6 after folding and sealing of the bottom panels and side end flaps.
Figure 8:
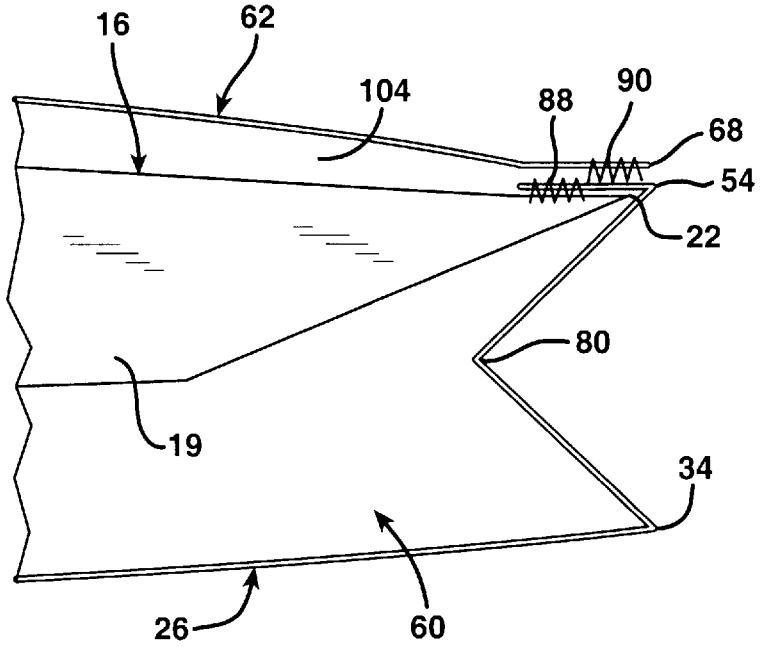
FIG. 8 is a top plan detail illustrating an alternative embodiment to that depicted in FIG. 5.
Figure 10:
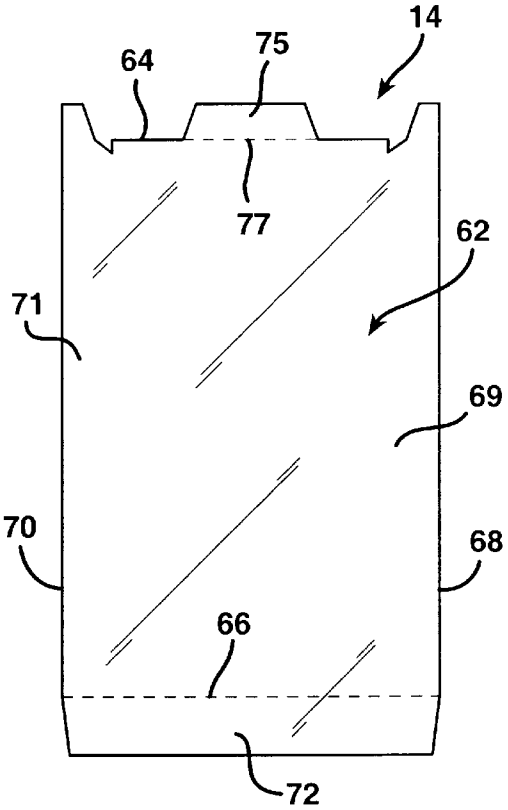
FIG. 10 is a plan view illustrating the sheet of pocket stock prior to folding which is used in the construction of the envelope of FIG. 1.
Figure 9:
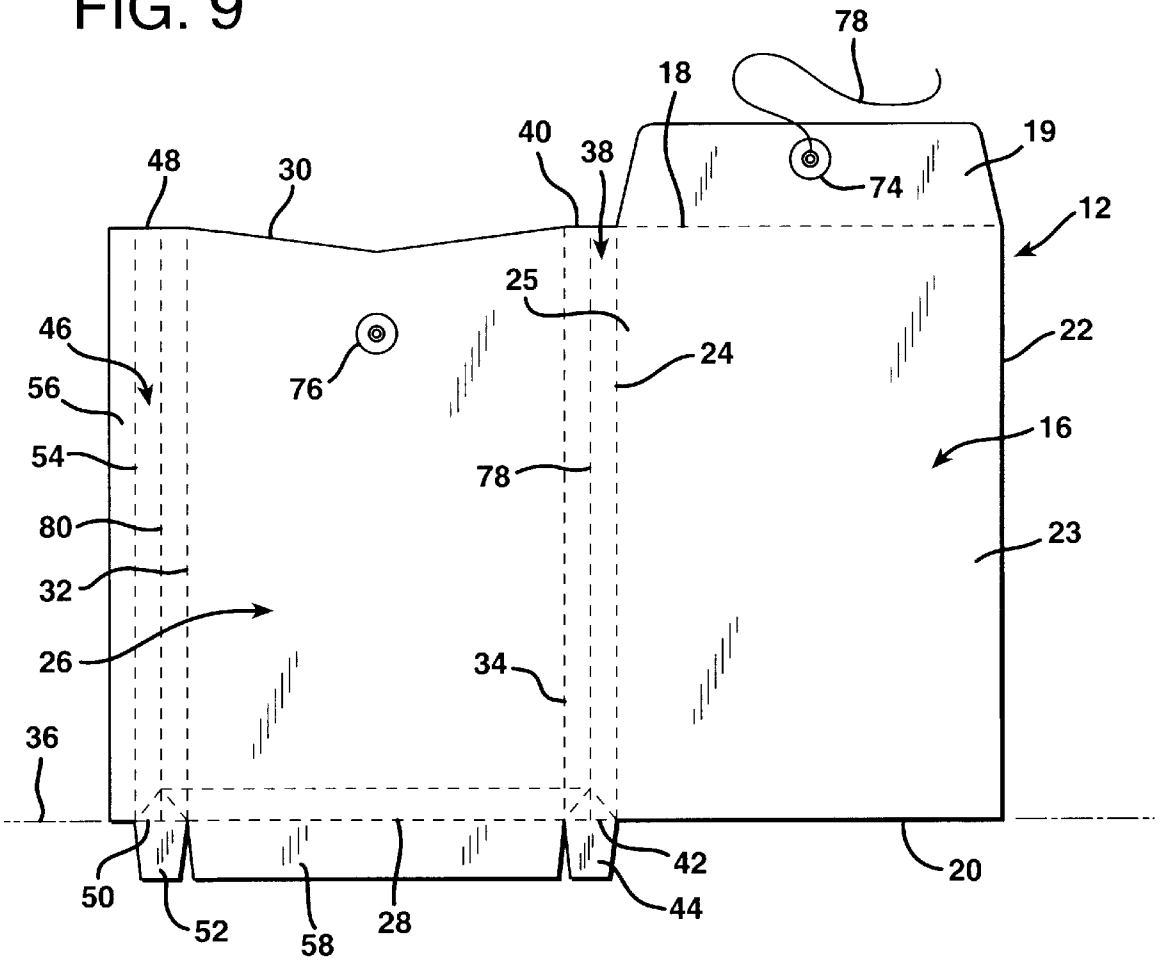
FIG. 9 is a plan view illustrating the sheet of base stock prior to folding which is used in the construction of the envelope of FIG. 1.

FIG. 1 illustrates an office envelope 10 comprising at least one, and in the embodiment of FIGS. 1–10, a total of two sheets of flat stock including a base sheet 12 and a pocket sheet 14 illustrated in FIGS. 9 and 10, respectively. Both the base sheet 12 and the pocket sheet 14 may be formed of polyethylene or polypropylene. Preferably, the base sheet 12 is formed of an opaque polyethylene while the pocket sheet 14 is clear. As illustrated in FIG. 9, the base sheet 12 is cut and folded to form a back panel 16 which is bounded by a back panel top edge 18, a back panel bottom edge 20 parallel to the back panel top edge 18, and a pair of mutually parallel back panel side edges 22 and 24. The back panel side edges 22 and 24 are both perpendicular to the back panel top edge 18 and the back panel bottom edge 20.

The base sheet 12 also defines a front panel 26 having a front panel bottom edge 28, an opposing front panel top edge 30, and a pair of front panel side edges 32 and 34. The front panel side edges 32 and 34 are both parallel to the back panel side edges 22 and 24 and extend between the front panel top edge 30 and the front panel bottom edge 28.

The front panel bottom edge 28 is linearly aligned with the back panel bottom edge 20. That is, both of the edges 20 and 28 lie on the same straight linear line 36 when the face sheet 12 is in the unfolded condition depicted in FIG. 9.

The base sheet 12 also defines a web side panel 38 having a top web side edge 40 and a bottom web side edge 42 with a trapezoidal-shaped side panel bottom closure flap 44 extending from the bottom web side edge 42.

The web side panel 38 is delineated by the first back and front panel side edges 24 and 34 and by the top web side edge 40 and the bottom web side edge 42. The web side panel 38 is thereby bounded on both of its opposite sides by the front panel 16 and the back panel 26.

The base sheet 12 also defines an overlap side panel 46 located alongside and delineated at a second side edge of one of the front and back panels 16 and 26. In the embodiments illustrated in FIGS. 1–10, the one of the front and back panels 16 and 26 alongside which the overlap side panel 46 is located is the front panel 26. The other of the front and back panels 16 and 26 is the back panel 16. The side edge 24 of the back panel 16 and the side edge 34 of the front panel 26 may be considered to be the first side edges of their respective back and front panels 16 and 26. The base sheet 12 also defines a base sheet bottom panel 58 which extends from the first one of the front and back panels, namely the front panel 26 at the bottom edge 28 thereof.

The front panel 26 is longitudinally bounded by folds with the side panels 38 and 46. These folds lie at the opposing side edges 32 and 34 of the front panel 26. The overlap side panel 46 has a top overlap side edge 48, a bottom overlap side edge 50, and a small trapezoidal-shaped overlap side panel bottom closure flap 52 extending from the bottom overlap side edge 50. The overlap side panel 46 is delineated from the front panel 26 at the second side edge 32 of the front panel 26. One of the side edges of the overlap side panel 46 is formed by the second edge 32 of the front panel 26. The other side edge of the overlap side panel 46 is an edge 54 which is parallel to the second side edge 32.

The overlap side panel 46 has an overlap margin 56 that projects outwardly from the side edge 54 of the overlap side panel 46. The overlap margin 56 extends laterally in a direction away from the front panel 26.

Figure 3:
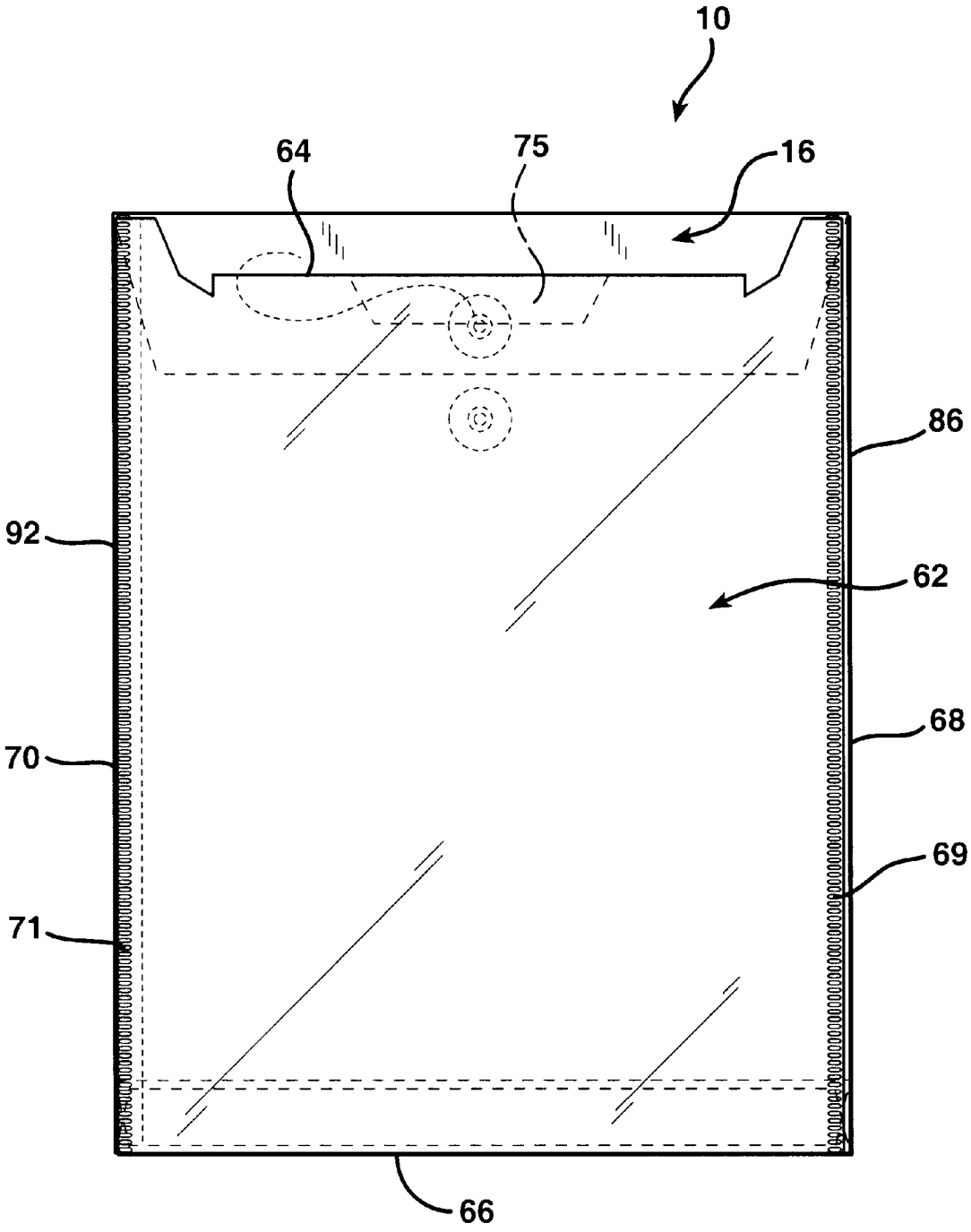
FIG. 3 is a rear elevational view of the office envelope of FIG. 1.
Figure 4:
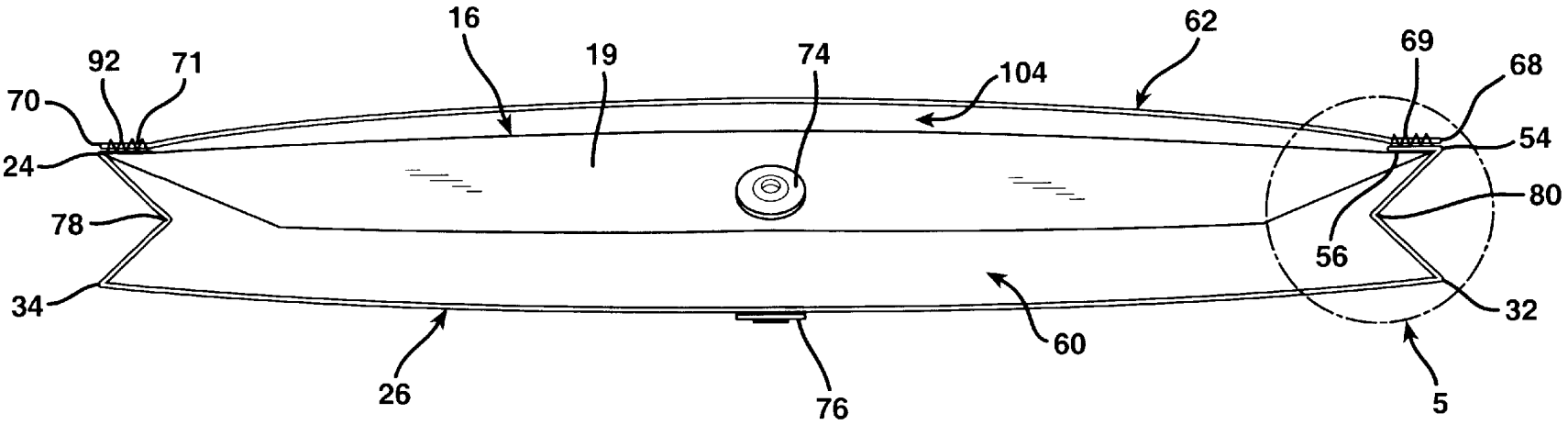
FIG. 4 is a top plan view of the office envelope of FIG. 1.
Figure 5:
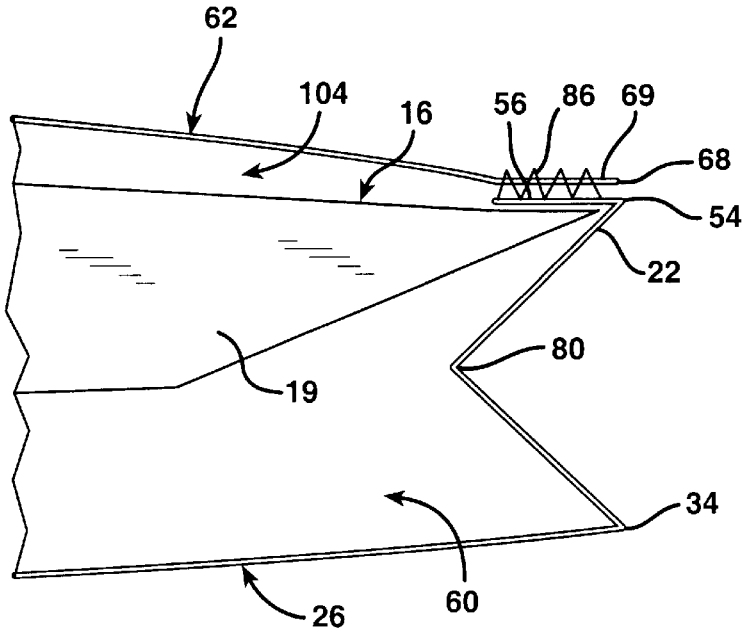
FIG. 5 is a detail indicated at 5 in FIG. 4.

As illustrated in FIGS. 1–4, the panels 16, 26, 38, 46, and 58 formed on the base sheet 12 are folded along all of the longitudinally extending panel edges 24, 34, 32, and 54 and the bottom panel 58, and the side panel bottom closure flaps 44 and 52 are folded along the laterally extending edges 28, 42, and 50 to define an enclosure 60 therewithin, as illustrated in FIG. 4. The overlap margin 56 of the overlap side panel 46 contacts and is sealed to the other of the front and back panels, namely the back panel 16 throughout a sealing margin 23, adjacent a second side edge 22 thereof, as best illustrated in FIGS. 4 and 5.

A closure flap 19 projects from the back panel top edge 18 of the back panel 16. In the finished office envelope 10, the closure flap 19 is folded over to overlap a portion of the front panel 26 remote from the bottom panels 58 and 72. The closure flap 19 is provided with a conventional disc-shaped plastic fastening button 74 at its center. Another plastic fastening button 76 is provided laterally centered in the upper portion of the front panel 26. A string 78 is secured to the rivet that attaches the closure button 74 to the closure flap 19. The button 74 on the closure flap 19, together with the attachment string 78, form a first closure element on the closure flap 19. The button 76 on the front panel 26 forms a second closure element thereon. The string 78 can be wound around the other closure button 76 to secure the enclosure 60 of the office envelope 10 shut. The first and second closure elements are releasably engageable together by winding the string 78 in a series of passes about the buttons 74 and 76, in a conventional manner.

The pocket sheet 14 is also of a uniform thickness throughout and is cut and folded to form a pocket panel 62 that is positioned to overly the back panel 16 of the base sheet 12. A generally trapezoidal-shaped pocket bottom panel 72 extends from the pocket bottom edge 66. The pocket sheet 14 also defines a pocket top edge 64, a pocket bottom edge 66, and a pair of mutually parallel pocket panel side edges 68 and 70.

Figure 6:
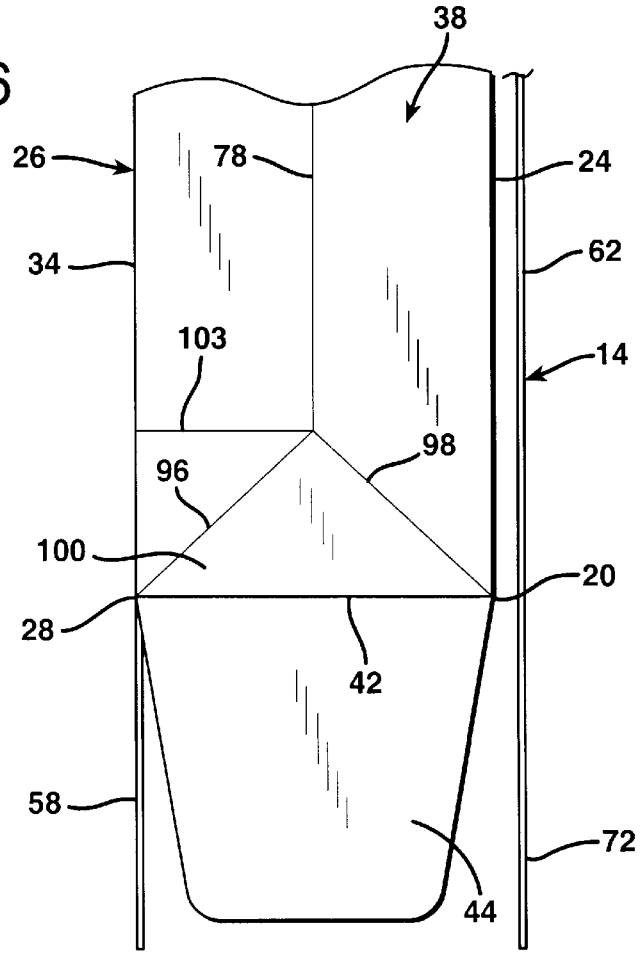
FIG. 6 is a left-side elevational detail of the lower portion of the envelope of FIG. 1 shown before folding and sealing of the bottom panels and side end flaps.

As illustrated in FIGS. 6 and 7, the pocket bottom panel 72 is folded to overlap and is sealed to the base sheet bottom panel 58. One out of the pair of pocket panel side edges, specifically the pocket panel side edge 68, overlaps and is sealed to the base sheet 12 at the overlap margin 56 of the overlap side panel 46. The other of the pocket panel side edges, which is the edge 70, is sealed to the back panel 16 remote from and parallel to the overlap margin 56, as illustrated in FIG. 4.

The longitudinally extending side sealing regions of the pocket sheet 14 located immediately adjacent to the side edges 68 and 70 thereof are respectively indicated at 69 and 71. These regions are not delineated by folds in the pocket sheet 14, but may be considered to be side sealing margins approximately three-sixteenths of an inch in width and extending lengthwise along the pocket panel 62 immediately adjacent to the pocket side edges 68 and 70, respectively.

The region immediately adjacent to the back panel side edge 22 is indicated at 23. This region is not delineated by any fold, but is approximately three-sixteenths of an inch in width and runs throughout the length of the back panel 16 immediately adjacent to the side edge 22 thereof. The region 23 may be considered to be a sealing margin. A corresponding region 25 immediately adjacent to the back panel side edge 24 may also be considered to be a sealing margin.

The manner of attachment and sealing of the panels of the base sheet 12 and the pocket sheet 14 to each other is best illustrated in FIGS. 4–7. As illustrated in FIG. 5, in one preferred embodiment of the invention, one of the sealing margins of the pocket panel 62, specifically the sealing margin 69, is sealed to both the attachment margin 56 of the overlap side panel 46 and the attachment margin 23 of the back panel 16. Sealing throughout the length of the back panel 16 and pocket panel 62 is performed with a conventional heat sealing machine through three plies of plastic material. Specifically, the pocket panel 62, the overlap panel 46, and the back panel 16 are all sealed together by a single, linear heat seal, as illustrated in FIG. 5. In this embodiment, the same longitudinal seal indicated at 86, forms a longitudinal seal for the enclosure 60 adjacent the side edges 54 and 22 and also seals the pocket sheet 14 to the base sheet 12 along one edge of the pocket panel 62.

An alternative sealing arrangement according to the invention is illustrated in FIG. 8. In that embodiment a first longitudinal seal 88 is employed to seal the overlapping margin 56 of the overlap panel 46 to the sealing margin 23 of the back panel 16 adjacent to the die cut edge 22 thereof. A second linear, longitudinally extending heat seal 90 is thereafter employed to seal the sealing margin 69 of the pocket panel 62 to the sealing margin 56 of the overlap panel 46. The embodiment of FIG. 5 has the advantage of requiring but a single thermal seal. The embodiment of FIG. 8 has the advantage of requiring seals through only two plies of material.

With either the embodiment of FIG. 5 or the embodiment of FIG. 8, the bottom of the enclosure 60 is closed and sealed as illustrated in FIGS. 6 and 7. As shown in these drawing figures, the side panel bottom closure flaps 44 and 52 are first folded along the lines 42 and 52, respectively, upwardly from a vertical orientation as illustrated in FIG. 6 to a horizontal orientation as illustrated in FIG. 7. The base sheet bottom panel 58 that extends from the front panel 26 is next folded up along the front panel bottom edge 28 from the generally vertical orientation shown in FIG. 6 to a horizontal orientation shown in FIG. 7.

Finally, the bottom panel 72 of the pocket sheet 14 is folded upwardly about the bottom edge 66 of the pocket panel 62 from the generally vertical orientation illustrated in FIG. 6 to the generally horizontal orientation illustrated in FIG. 7. The bottom panel 72 of the pocket sheet 14 is folded upwardly on the outside of the bottom panel 58, which in turn is folded upwardly against the undersides of the side panel bottom closure flaps 44 and 52. The bottom panels 72 and 58 are thereupon sealed together by a single transverse seal indicated at 94 in FIG. 7. This step in the fabrication of the envelope 10 closes the bottom of the envelope 10, as well as the bottom of the outside pocket formed between the pocket panel 62 and the front panel 26. A pocket enclosure 104 is thereby defined between the pocket panel 62 and the underlying back panel 16 of the envelope 10.

Once the single seal 86 of FIG. 5 or the double seals 88 and 90 of FIG. 8 have been created to attach the first side edge 68 of the pocket panel 62 to the back panel 16 adjacent the die cut edge 22 thereof, the other side sealing margin 71 of the pocket sheet 14 is sealed to the back panel 16 at the sealing margin 25 near the longitudinal edge 24 thereof. That is, the seal 92, shown in FIG. 4, is created through the two plies of material of the base sheet 12 and pocket sheet 14 that are to be sealed remote from the overlap sealing margin 56.

As shown in FIGS. 2 and 4–7, each of the base sheet side panels 38 and 46 has a longitudinal fold 78 and 80, respectively, extending from the top edges 40 and 48 to near, but just short of, the bottom edges 42 and 50, thereof. The longitudinal folds 78 and 80 form pleats in both of the side panels 38 and 46, as best illustrated in FIG. 4.

The base sheet 12 is preferably folded with short diagonal folds 96 and 98 in the lower regions of the side panels 38 and 46 to create small, triangular-shaped panels 100 in the base sheet 12 immediately above the side panel bottom closure flaps 44 and 52. Also, a fold 102 is preferable formed across the front panel 26 parallel and closely adjacent to the bottom edge of the front panel 26 and folds 103 are formed in the side panels 38 and 46 from the ends of the fold 102 to the apices of the triangular-shaped panels 100. Together, the folds 78, 80, 96, 98, 102, and 103 permit the envelope 10 to be fully collapsed from the expanded condition depicted in FIG. 2 to a collapsed condition in which the front panel 26 resides in contact with the back panel 16 throughout most of their mutually adjacent surface areas. This folding technique allows a multiplicity of envelopes 10 to be packaged together while occupying a minimum volume. The collapsed envelopes 10 can thereby be stored and shipped within a relatively compact volume.

Once all of the seals 92, 94, and 86 or 88 and 90 have been established, the office envelope 10 is ready for use. As illustrated in FIG. 4, the pleats in the side panels 38 and 46 allow the sides of the envelope 10 to be expanded or collapsed to accommodate the necessary volume of papers in the enclosure 60. Since, the pocket sheet 14 is transparent, a routing sheet placed in the pocket enclosure 104 is clearly visible from the back when the pocket panel 62 is exposed, as illustrated in FIG. 3.

Individuals who receive the envelope 10 may unfasten and refasten the top closure flap fastening buttons 74 and 76 utilizing the fastening string 78. As each user passes the envelope 10 along to next person on the routing list, the user makes an indication on the routing sheet contained in the pocket 104 to indicate receipt and awareness of the contents of the routing envelope 10.

The retaining tab 75 that projects outwardly from the top edge 64 of the pocket panel 62 is folded along fold line 77 so as to extend back down into the pocket 104. The retaining tab 75 is located remote from the bottom panels 58 and 72 and is folded back toward the bottom panels 58 and 72 between the pocket panel 62 and the back panel 16 to which the pocket panel 62 is sealed. The retaining tab 75 thereby serves as a means for retaining the routing sheet in the pocket 104 as the envelope 10 is routed from one person to the next. That is, the retaining tab 75 engages the center of the top edge of a routing sheet inserted into the pocket 104, and prevents it from inadvertently becoming separated from the envelope 10.

In the embodiments of FIGS. 1–10, the front panel 26, the back panel 16, the top closure flap 19, the side panels 38 and 46, and the side panel bottom closure flaps 44 and 52 and one of the bottom panels, specifically the bottom panel 58, are formed from the same sheet 12 of flat stock. The pocket panel 62 and the other bottom panel 72 are formed from a different sheet of flat stock. As previously indicated, the pocket sheet 14 is preferably transparent, while the base sheet 12 is preferably opaque in nature.

Figure 12:
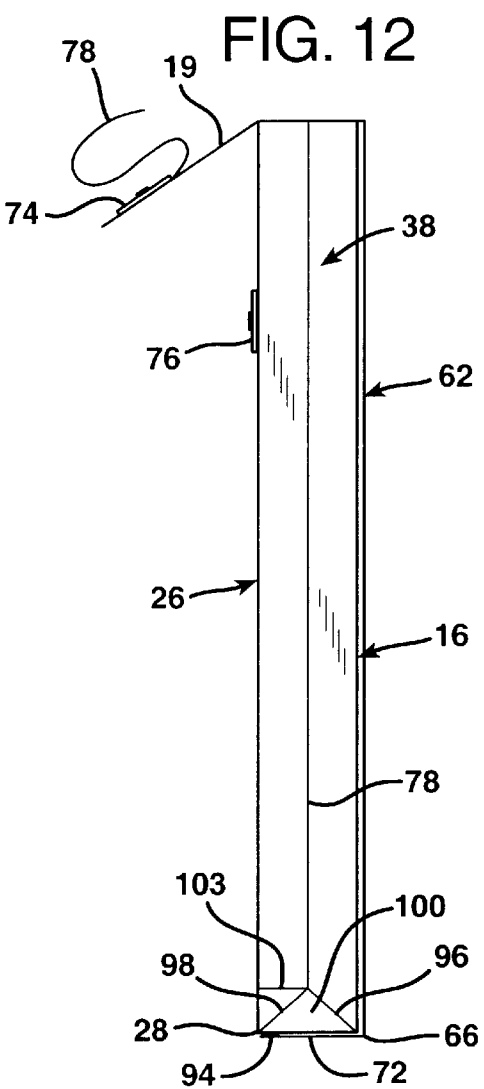
FIG. 12 is right-side elevational view of the envelope of FIG. 11.
Figure 11:
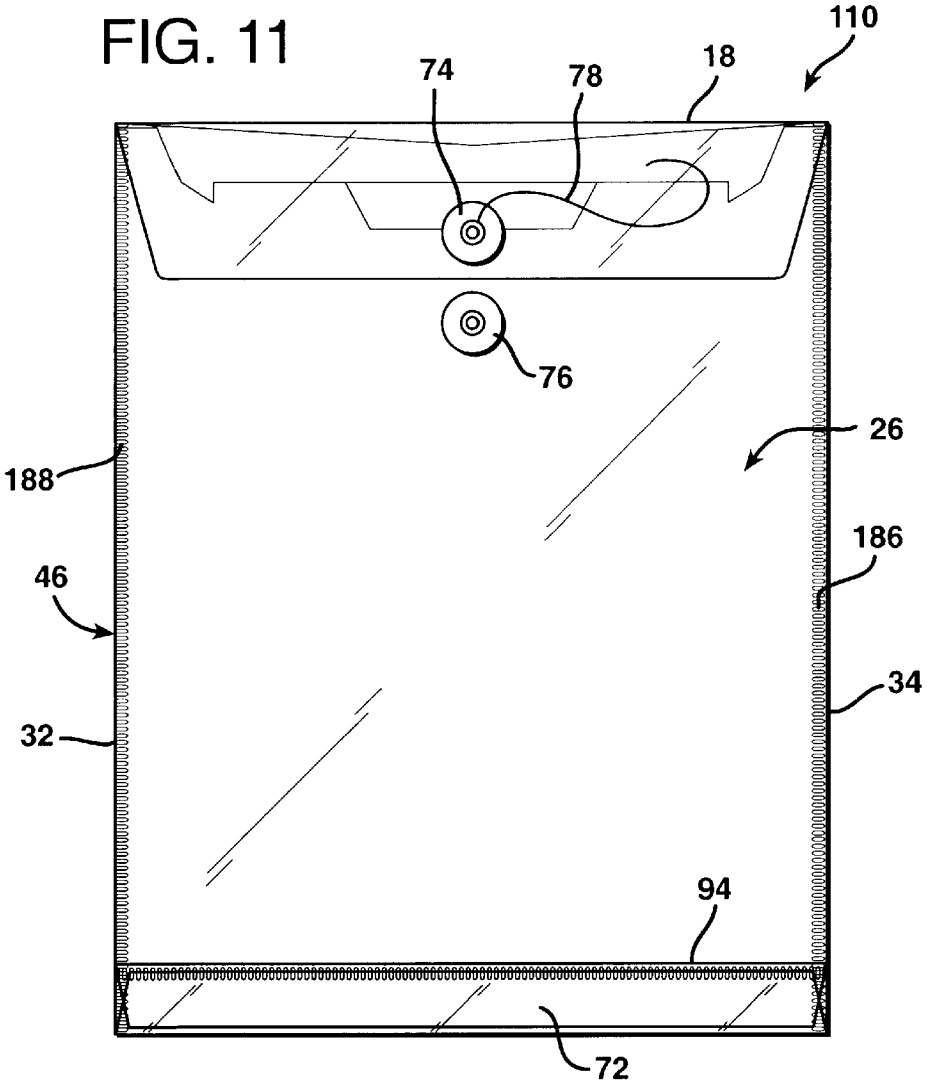
FIG. 11 is a front elevational view of an alternative embodiment of the office envelope of the invention.
Figure 13:
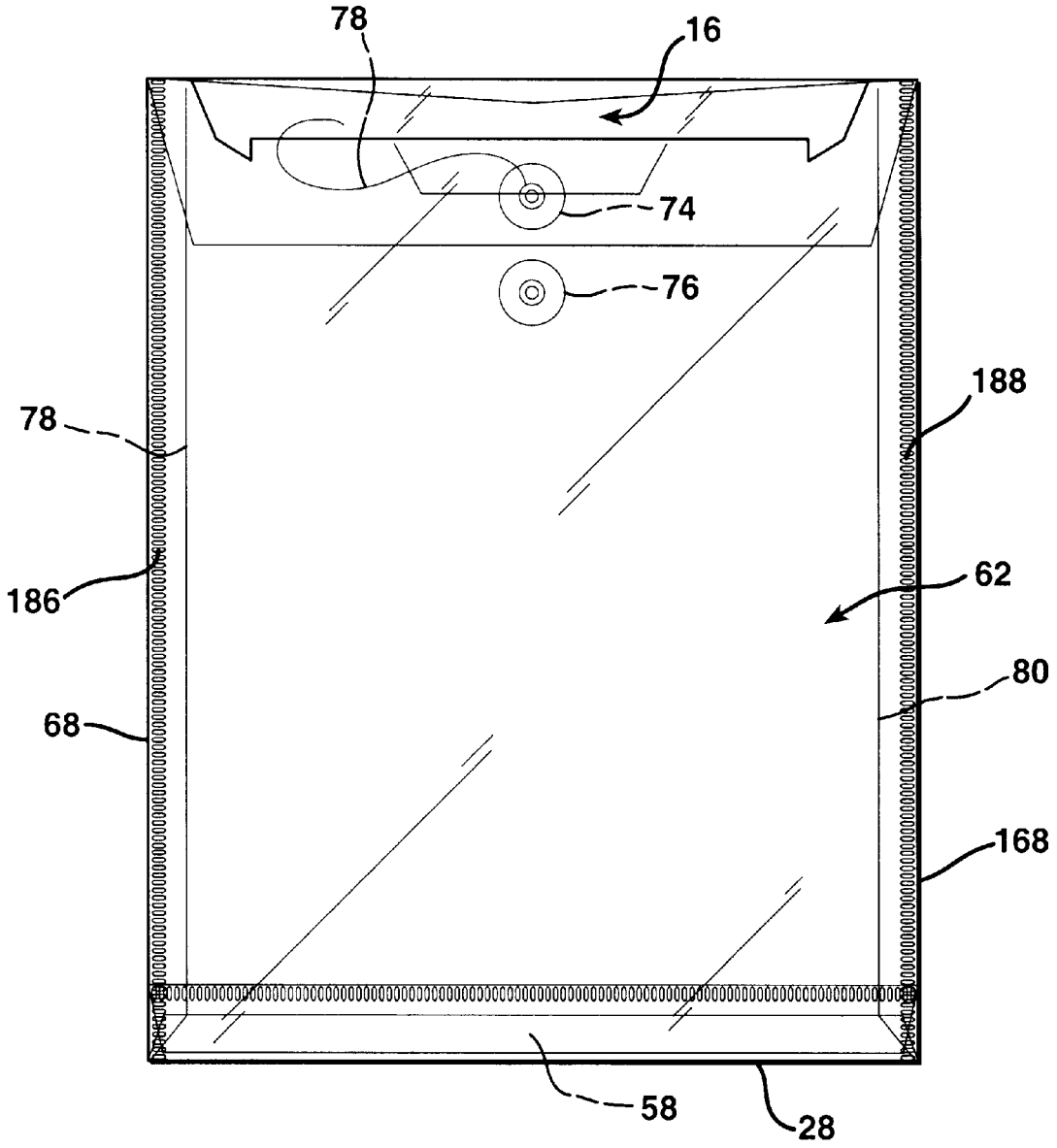
FIG. 13 is a rear elevational view of the envelope of FIG. 11.
Figure 14:
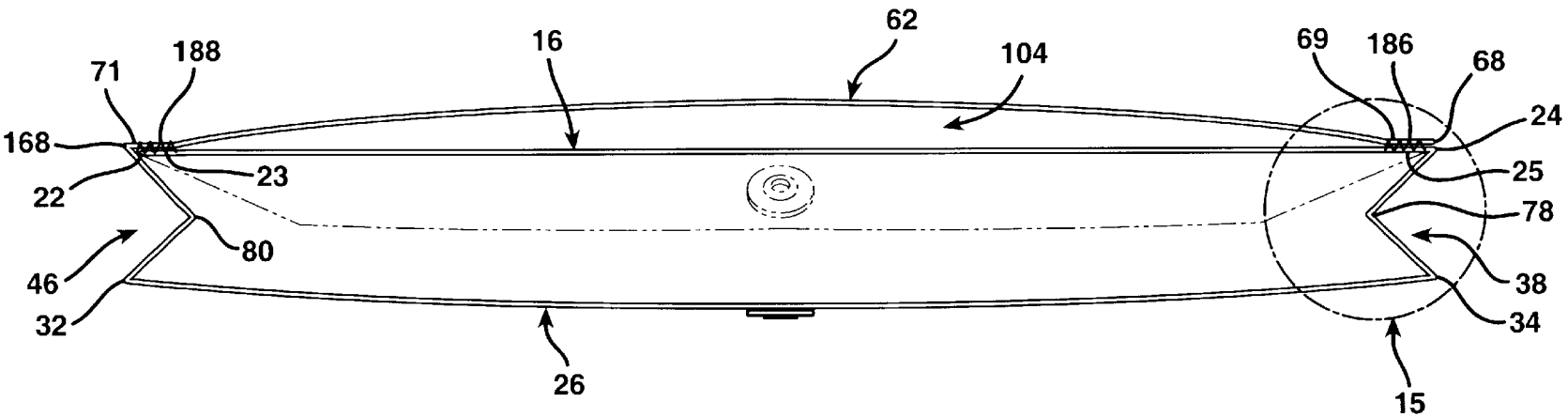
FIG. 14 is a top plan view of the envelope of FIG. 11.
Figure 15:
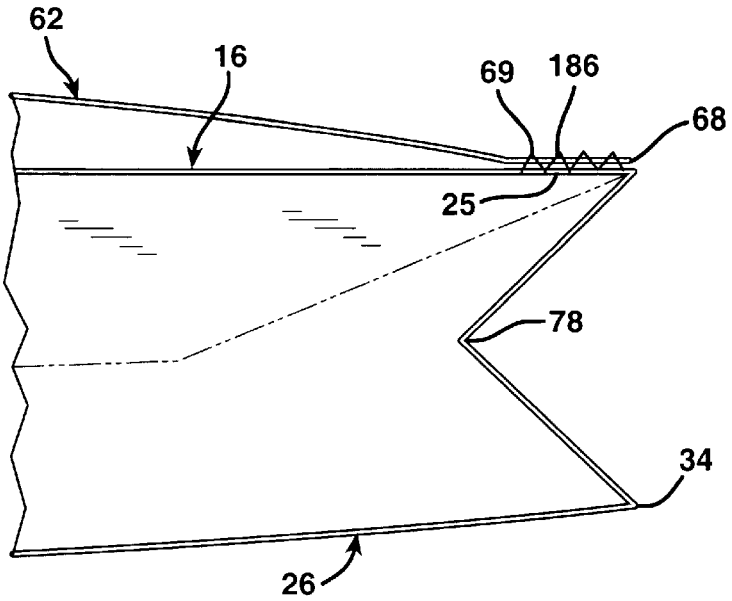
FIG. 15 is a detail indicated at 15 in FIG. 14.
Figure 18:
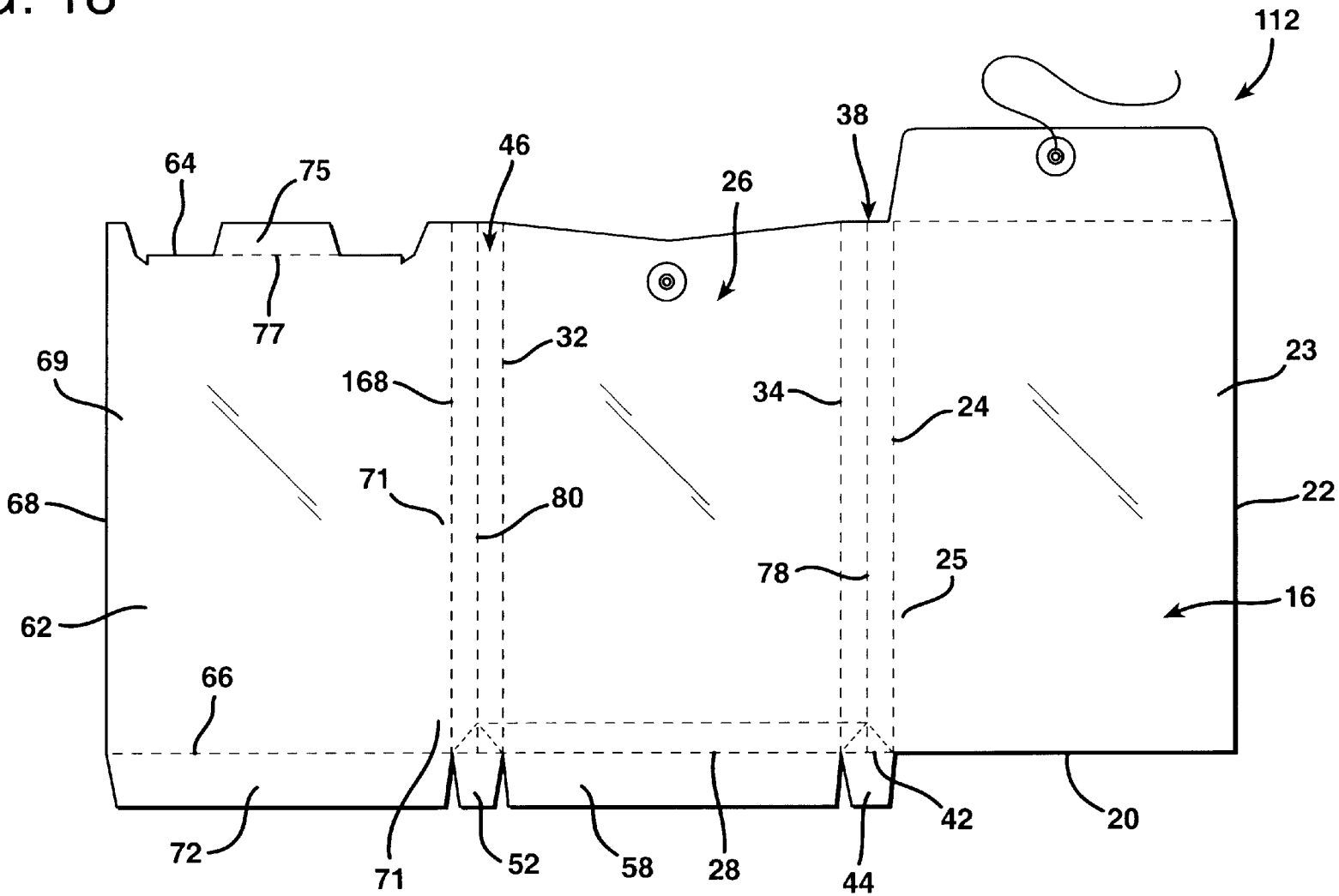
FIG. 18 is a plan view showing the single sheet of flat stock prior to folding used in the construction of the envelope of FIG. 11.

In some instances it may be more desirable to create the envelope of the invention from a single sheet of flat stock, such as the flat sheet of polypropylene or polyethylene 112 illustrated in FIG. 18. The single sheet of flat stock 112 illustrated in FIG. 18 is utilized to create an office envelope 110, illustrated in FIGS. 11, 12, and 13. In the office envelope 110, all of the panels, flaps, margins, and edges are formed by articulated folds in the same sheet of flat stock 112. The sheet 112 may, for example, be formed of a translucent plastic.

The office envelope 110 includes all of the same panels and edges as the envelope 10. These are identified by the same reference numbers in FIGS. 11–18 as in FIGS. 1–10 where there is no difference at all in the nature of the panel, margin, or seal involved. Since the office envelope 110 is fabricated from a single flat sheet 112 of polypropylene or polyethylene stock, rather than two sheets, there is no overlap margin 56 in the envelope 110. Rather, the outside edge of the side panel 46 remote from the back panel edge 22 in the sheet of flat stock is formed by a fold 168 in the single sheet 112. The fold 168 serves both as the first edge of the pocket panel 62 and also as the edge of the side panel 46 opposite the other side edge 32 thereof.

Figure 16:
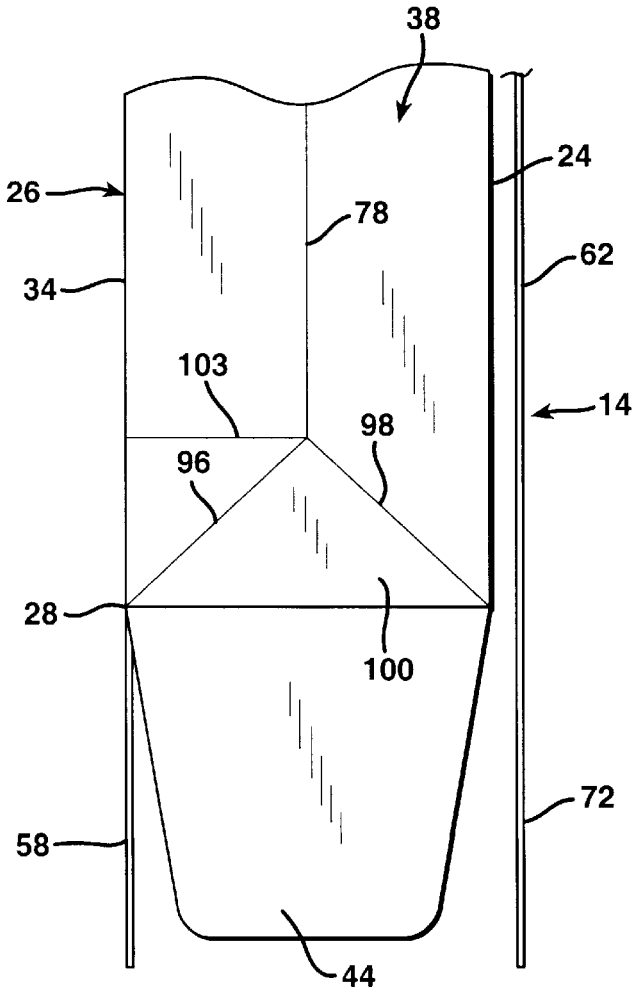
FIG. 16 is a left-side elevational view of the lower portion of the envelope of FIG. 11 shown prior to folding and sealing of the bottom panels and the side end flaps.
Figure 17:
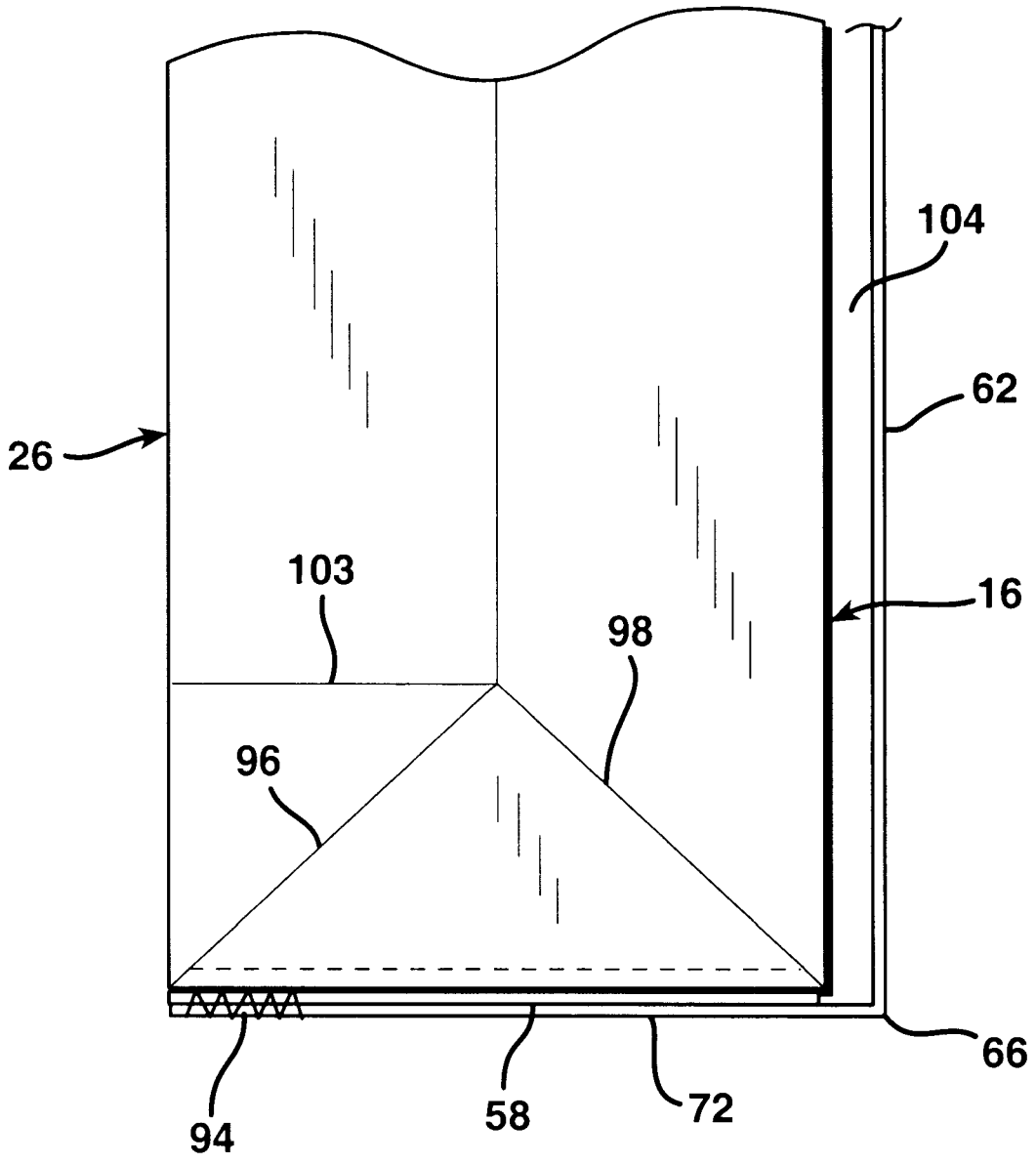
FIG. 17 is a left-side elevational detail illustrating the portion of the envelope of FIG. 16 shown after folding and sealing of the bottom panels and side end flaps.

The bottom of the envelope 110 is formed by folding and sealing the bottom panels 58 and 72 and the side panel bottom closure flaps 44 and 52 in the same manner as illustrated in FIGS. 6 and 7. The closing and sealing of the bottom of the office envelope 110 as depicted in FIGS. 16 and 17 is identical to the closure and sealing of the bottom of the office envelope 10 depicted and described in conjunction with FIGS. 6 and 7.

The same alternative edge sealing technique illustrated in FIG. 5 may be utilized to fabricate the envelope 110. In the embodiment illustrated in FIG. 15, a single heat seal 186 has been employed to seal the pocket side sealing margin 69 of the pocket panel 62 to the facing surface of the back panel 16 immediately adjacent the side edge 24 thereof. The seal 186 extends through only the two plies of material at the region 69 of the pocket panel 62 and the facing region 25 of the back panel 16 adjacent the side edge 24 thereof. Another longitudinally extending heat seal 188 is utilized to seal the other sealing region 71 of the pocket panel 62 to the sealing margin 23 of the back panel 16.

Undoubtedly, numerous variations and modifications of the invention will become readily apparent to those familiar with office supply products, such as routing envelopes. For example, in the embodiments of FIGS. 1–10, the position of the front and back panels 16 and 26 can be reversed, so that the back panel 16, rather than the front panel 26, is bounded on both sides by the side panels 38 and 46. Accordingly, the scope of the invention should not be construed as limited to the specific embodiments depicted and described.

I claim:

1. An envelope for documents having an outside pocket and comprised of at least one sheet of flat stock cut and folded to form a front panel, a back panel, a web side panel, an overlap side panel, a pair of side panel bottom flaps, an inside bottom panel, an outside bottom panel, and a pocket panel having opposite side edges with side sealing margins adjacent thereto, wherein one of said front and back panels is delineated from said side panels by folds in said sheet, the other of said front and back panels has a longitudinally cut side edge defined by a cut end of said sheet and a first attachment margin on said other of said front and back panels lies immediately adjacent to said cut side edge thereof, and said overlap side panel has an attachment margin and a longitudinally cut side edge defined by another cut end in said sheet immediately adjacent to said attachment margin thereof, and said attachment margins of said overlap side panel and said other of said front and back panels are sealed to each other throughout their lengths, and one of said side sealing margins of said pocket panels is sealed to at least one of said attachment margins of said overlap side panel and said other of said front and back panels, and the other of said side sealing margins of said pocket panel is sealed to said other of said front and back panels adjacent to said web side panel, and said bottom panels and said side panel bottom flaps are folded together and said bottom panels are sealed to each other.

2. An envelope according to claim 1 wherein all of said panels, flaps, margins, and edges are formed by articulated folds in the same sheet of flat stock.

3. An envelope according to claim 1 wherein said one of said side sealing margins of said pocket panel is sealed to said attachment margin of said overlap side panel.

4. An envelope according to claim 1 wherein said one of said sealing margins of said pocket panel is sealed to both of said attachment margins of said overlap side panel and said other of said front and back panels.

5. An envelope according to claim 1 wherein said one of said front and back panels is said front panel and said other of said front and back panels is said back panel.

6. An envelope according to claim 5 further comprising a closure flap projecting from said back panel and extending thereacross throughout its width, and said closure flap is folded down to overlap a portion of said pocket panel.

7. An envelope according to claim 6 further comprising a retaining tab projecting from said pocket panel remote from said bottom panels, and said retaining tab is folded down into said outside pocket toward said bottom panels.

8. An envelope according to claim 6 further comprising a first closure element on said closure flap and a second closure element on said pocket panel, and said first and second closure elements are releasably engageable together.

9. An envelope according to claim 1 wherein said inside bottom panel is delineated by a bottom fold from said one of said front and back panels and said outside bottom panel is delineated by another bottom fold from said pocket panel.

10. An envelope according to claim 1 wherein said front panel, said back panel, said side panels, said side panel bottom flaps, and one of said bottom panels are formed from a first sheet of flat stock as aforesaid and said pocket panel and said other bottom panel are formed of a second sheet of flat stock as aforesaid.

11. An envelope according to claim 10 wherein said first sheet of flat stock is formed of an opaque material and said second sheet of flat stock is formed of a transparent material.

12. An envelope according to claim 1 wherein longitudinal folds form pleats in both of said side panels.

13. An envelope according to claim 1 wherein said bottom panels are sealed together by a single, transverse, linear seal.

14. An office envelope comprising:

a base sheet of stock of uniform thickness throughout folded to form overlaying front and back panels laterally separated by a pair of side panels therebetween wherein one of said front and back panels is laterally bounded on both sides by said side panels and is delineated therefrom by longitudinal folds in said base sheet, and the other of said front and back panels is laterally bounded on only one of its sides by one of said side panels and has a longitudinal die cut edge with an edge margin adjacent thereto extending throughout its length, and one of said side panels is located between said front and back panels and is delineated therefrom by longitudinal folds in said base sheet while the other of said side panels has a longitudinal die cut edge with an edge margin adjacent thereto extending throughout its length, and said edge margins of said other side panel and of said other of said front and back panels overlap and are sealed together throughout their lengths, and said base sheet further defines a base sheet bottom panel projecting from said one of said front and back panels and side end flaps projecting from said side panels adjacent said base sheet bottom panel, and a pocket sheet of uniform thickness throughout folded to form a pocket panel overlying said other of said front and back panels and having opposing longitudinal side edges with pocket panel edge margins adjacent thereto and extending throughout the length of said pocket panel, and a pocket sheet bottom panel projecting from said pocket panel, and both of said bottom panels and said side end flaps are folded into a mutually overlying relationship and said bottom panels are sealed together and one of said pocket panel edge margins is sealed throughout its length to at least one of said edge margins of said base sheet that overlap each other and the other of said pocket panel edge margins is sealed throughout its length to said other of said front and back panels remote from said side edge margins of said base sheet.

15. An office envelope according to claim 14 wherein said one of said pocket panel edge margins is sealed to said edge margin of said other side panel.

16. An office envelope according to claim 14 wherein said one of said pocket panel edge margins is sealed to both said edge margin of said other side panel and to said edge margin of said other of said front and back panels.

17. An office envelope according to claim 14 further comprising a closure flap projecting from said other of said front and back panels and releasable closure flap engagement elements to hold said closure flap folded over to overlap a portion of said one of said front and back panels remote from said bottom panels.

18. An office envelope according to claim 14 further comprising a retaining tab projecting from said pocket panel remote from said bottom panels and folded back toward said bottom panels between said pocket panel and said other of said front and back panels.

19. An office envelope comprising:

a sheet of base stock of uniform thickness throughout cut and folded to form a back panel defining a back panel top edge, a back panel bottom edge parallel to said back panel top edge, and a pair of mutually parallel back panel side edges both perpendicular to said back panel top and bottom edges, a front panel having a front panel bottom edge linearly aligned with said back panel bottom edge, an opposing front panel top edge, and a pair of front panel side edges both parallel to said back panel side edges and extending between said front panel top and bottom edges, a web side panel delineated at a first side edge of each of said front and back panels and having a top web side edge and a bottom web side edge with a web side closure flap extending from said bottom web side edge, an overlap side panel located alongside and delineated at a second side edge of one of said front and back panels wherein said one of said front and back panels is longitudinally bounded by folds with said side panels, and said overlap side panel has a top overlap side edge, a bottom overlap side edge, and an overlap side closure flap extending from said bottom overlap side edge, and an overlap margin extending laterally in a direction away from said one of said front and back panels, and a base sheet bottom panel extending from said one of said front and back panels, and said panels are folded along all of said side edges to define an enclosure therewithin, with said overlap side panel overlap margin contacting and sealed to the other of said front and back panels adjacent to a second of said side edges thereof, and a sheet of pocket stock of uniform thickness throughout cut and folded to form a pocket panel overlying said other of said front and back panels and having a pocket top edge, a pocket bottom edge, a pair of mutually parallel pocket side edges, and a pocket bottom panel extending from said pocket bottom edge, and said pocket bottom panel is folded to overlap and is sealed to said base sheet bottom panel, and one of said pair of pocket side edges overlaps and is sealed to said base sheet at said overlap margin thereof and the other of said pocket side edges is sealed to said other of said front and back panels remote from and parallel to said overlap margin.

20. An office envelope according to claim 19 wherein said sheet of base stock is opaque and said sheet of pocket stock is transparent.

* * * * *